United States Patent [19]

Boucherie

[11] 4,430,039

[45] Feb. 7, 1984

[54] FIBRE LOADING DEVICE FOR A BRUSH MANUFACTURING MACHINE

[75] Inventor: Leonel P. Boucherie, Roeselare, Belgium

[73] Assignee: Firma G.B. Boucherie, Izegem, Belgium

[21] Appl. No.: 236,613

[22] Filed: Feb. 20, 1981

[30] Foreign Application Priority Data

Feb. 26, 1980 [BE] Belgium ..... 58426

[51] Int. Cl.[3] ..... B65G 1/06

[52] U.S. Cl. ..... 414/417; 300/9; 414/331

[58] Field of Search ..... 414/403, 404, 417, 331; 221/79, 81; 222/216; 300/9

[56] References Cited

U.S. PATENT DOCUMENTS 3,340,176 9/1967 Belluso et al. ..... 414/417 X 3,762,581 10/1973 Gabbrielli ..... 414/331

*Primary Examiner*—Robert G. Sheridan

*Attorney, Agent, or Firm*—Bacon & Thomas

[57] ABSTRACT

A fibre loading device for a brush manufacturing machine, characterized in that it has a replaceable fibre box which has a number of fibre chambers; a mechanism which allows movement of the fibre chambers one by one in front of the fibre magazine of the brush manufacturing machine; and mechanism allowing the transfer of the fibres from a selected fibre chamber into the fibre magazine of the brush manufacturing machine.

5 Claims, 26 Drawing Figures

4
II
28
30
3
29
31
IV
35
IV
27
2
27
V
36
11
13
26
18
19
1
8
III
23
18
III
19
25
24
14
22
8
7
6
12
17
20
20
9
V
2
10
F6
16
15
II 3
9
18
8
35
28
16
17
26
30
20
5
27
4
15
12
32
13
33
10
21
24
23
14
1
11
25

Fig. 3
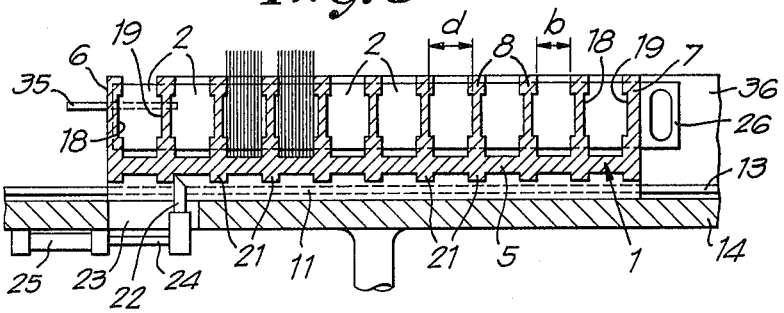
Fig. 4
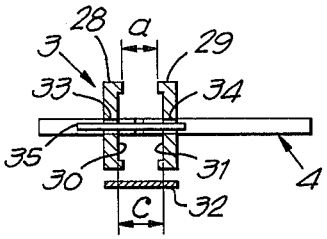
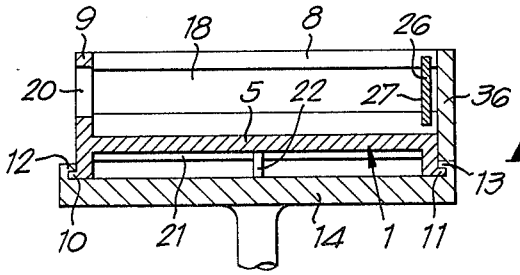
Fig. 5
Fig. 6
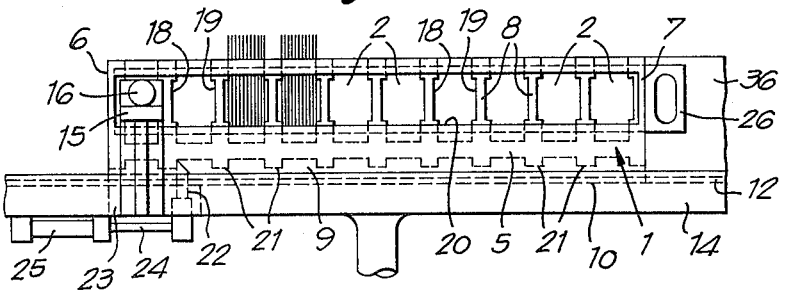

Fig. 9
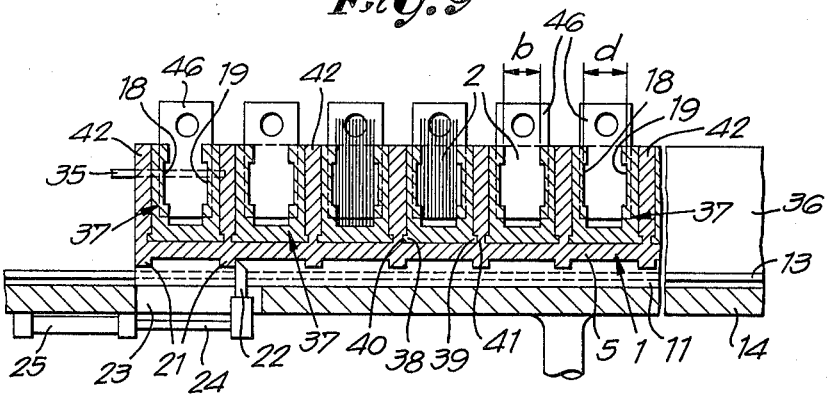
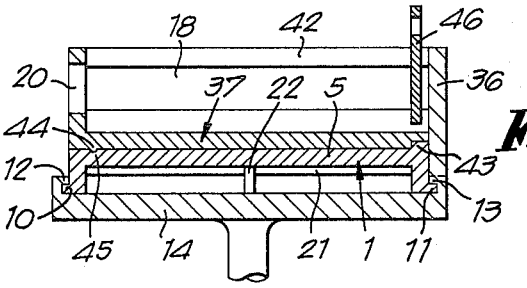
Fig. 10
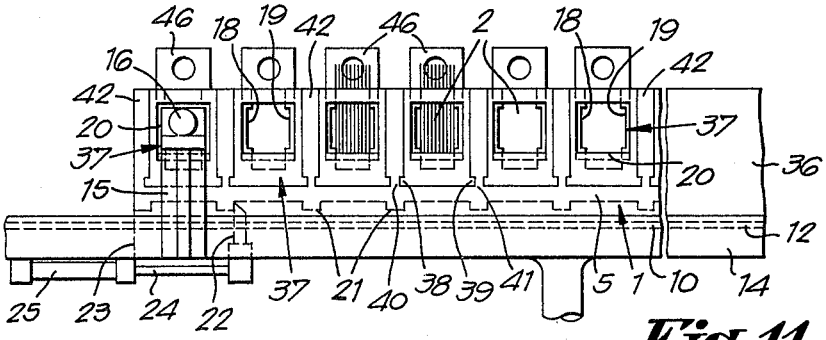
Fig. 11
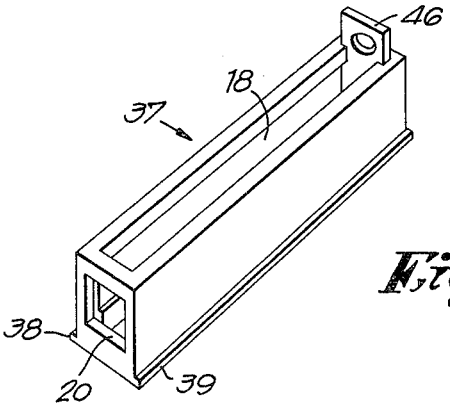
Fig. 12

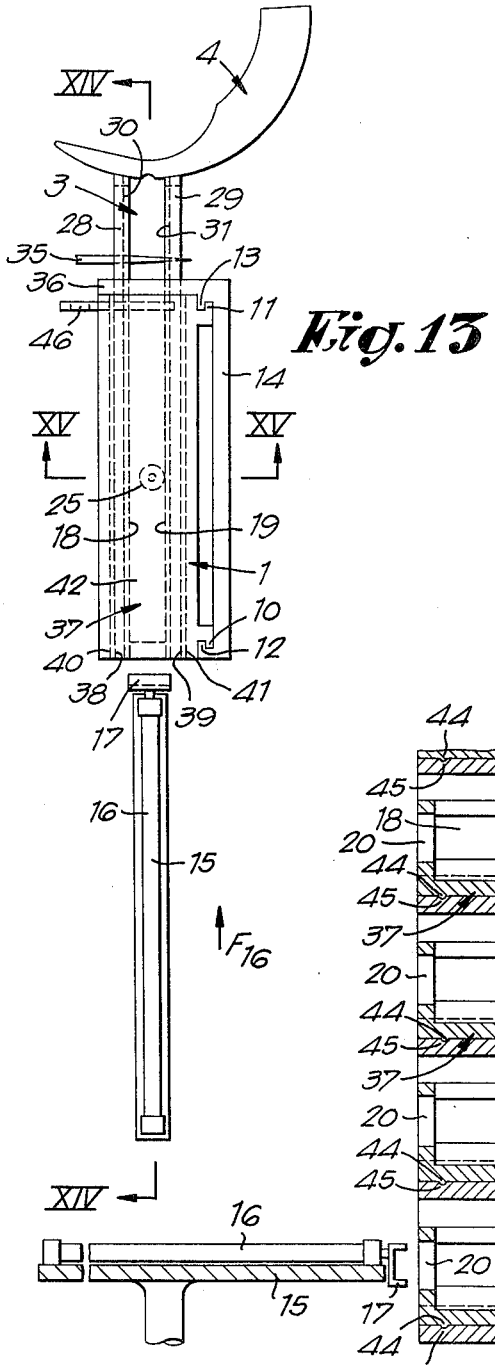
Fig. 13
Fig. 14
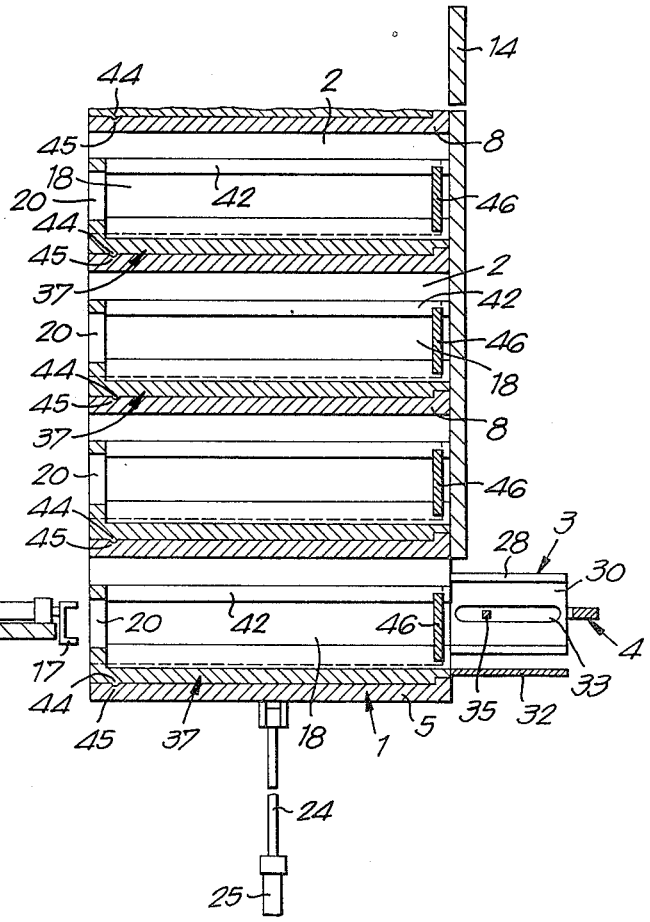

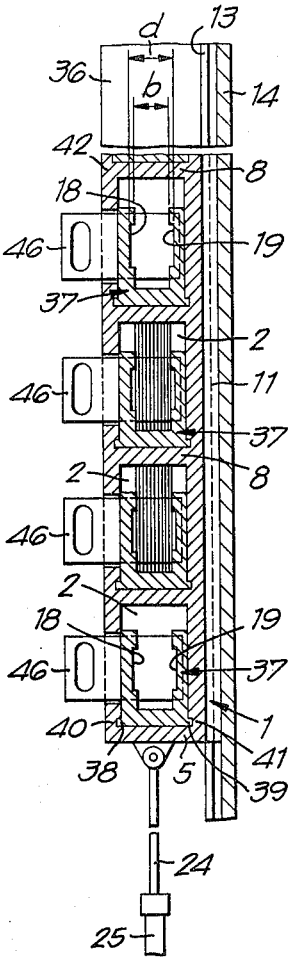
Fig. 15
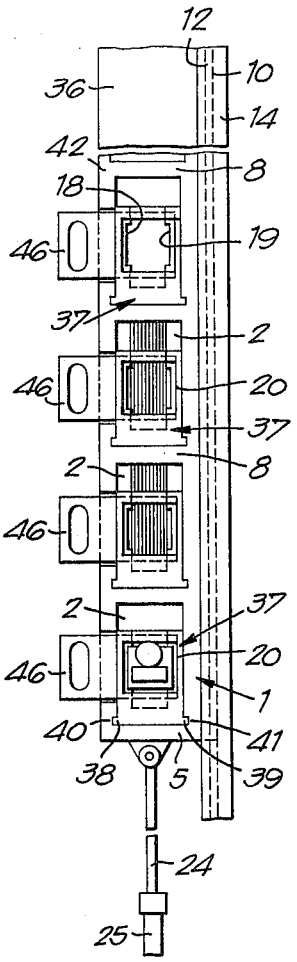
Fig. 16
Fig. 17
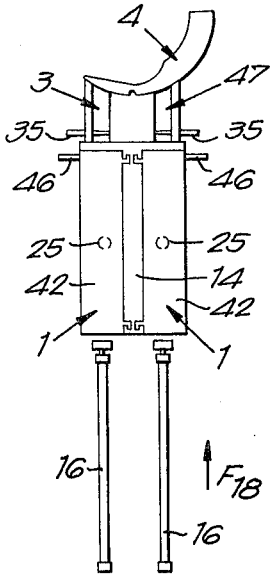
Fig. 18
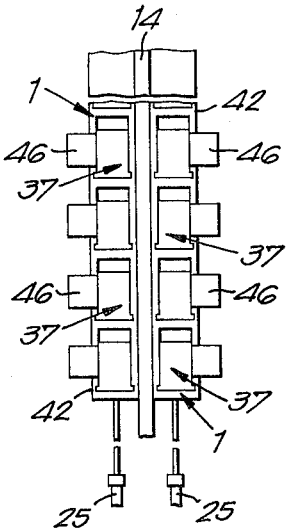

FIBRE LOADING DEVICE FOR A BRUSH MANUFACTURING MACHINE

It is a known fact that the fibre magazine of a brush manufacturing machine, from which the so-called bundle remover, for instance of the half-moon type, removes an appropriate quantity of fibres at each alternative motion and conveys it to the filling tool, has a rather limited capacity, so that this magazine must be regularly filled, which results in someone having to be nearly continuously present.

It is also known and has already been proposed that, in order to increase the autonomy of the brush manufacturing machine, each brush manufacturing machine may be equipped with an installation which fills the machine, respectively the fibre magazine, automatically with fibres. However, this has the drawback of each machine requiring a rather complicated filling mechanism, whereby not only is the cost of such a brush manufacturing machine significantly increased, but also results in the machine becoming more subject to failure and reliability and reduced efficiency.

The object of the present invention is a fibre loading device by means of which there is mainly obtained that the aforesaid regular filling with fibres by hand is excluded and the autonomy of the machine is notably increased, on the one hand, while a part of the aforesaid fibre loading device is formed by, properly speaking, a fibre loader or fibre case, which is independent from the machine and which is filled at a location which is common to all brush manufacturing machines of a certain group. Thus, the brush manufacturing machine has no need for an expensive device for inserting the fibres into the fibre magazine, there being furthermore obtained that the machine is not subject to supplementary failures, due for instance to a fibre filling mechanism, whereby the machine retains its original reliability and efficiency.

The fibre loading device according to the invention which realizes the aforesaid and other advantages mainly comprises a replaceable fibre box, including a number of fibre chambers; means allowing to locate the aforesaid fibre chambers one by one in front of the fibre magazine of the brush manufacturing machine; and means allowing to transfer the fibres from a certain fibre chamber into the aforesaid fibre magazine of the brush manufacturing machine.

In order better to illustrate the characteristic features of the present invention, some preferred embodiments of the invention are described hereinafter as examples without any restrictive character, reference being made to the attached drawings, in which:

FIG. 1 shows schematically a top plan view of a device according to the invention in combination with a fibre magazine of a brush manufacturing machine;

FIGS. 2, 3, 4 and 5 respectively are sections according to the lines II—II, III—III, IV—IV and V—V of FIG. 1;

FIG. 6 shows a view according to the arrow F6 in FIG. 1;

FIGS. 8, 9 and 10 are respectively sections according to the lines VIII—VIII, IX—IX and X—X in FIG. 7;

FIG. 11 shows a view according to the arrow F11 in FIG. 7;

FIG. 12 shows in perspective a case which may be used in the device according to FIGS. 7 through 11;

Figure 1:
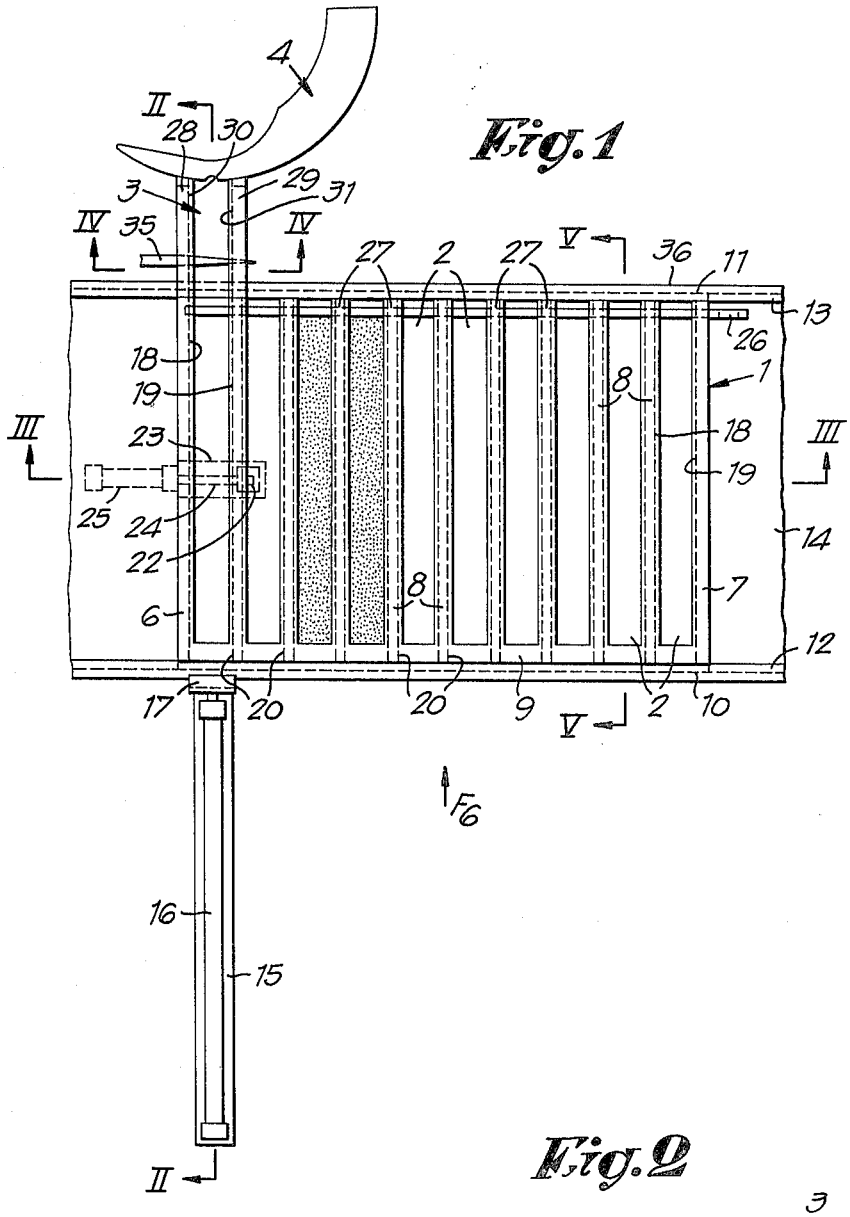
Figure 2:
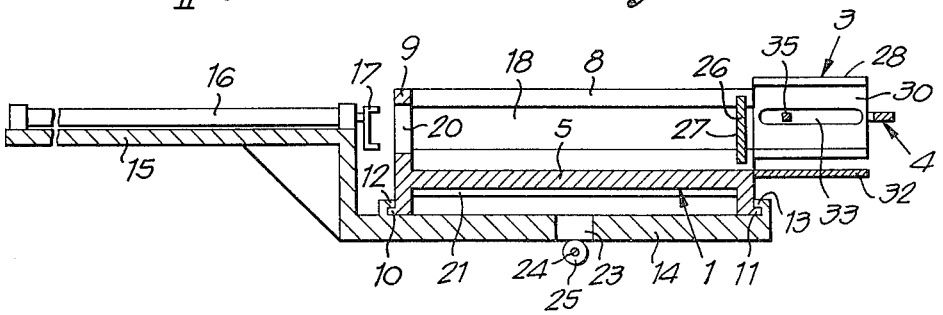
Figure 7:
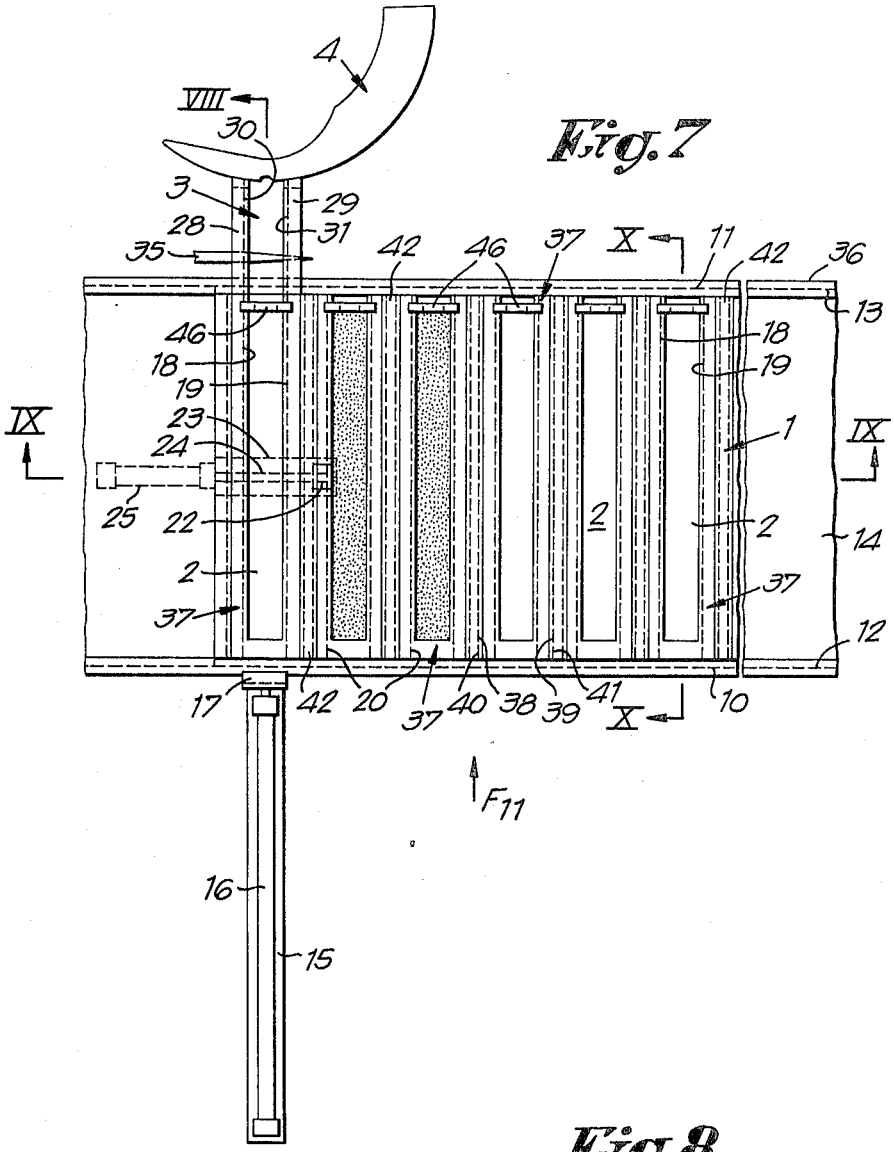
FIG. 7 is a view which is similar to the view of FIG. 1, but for an execution variant.
Figure 8:
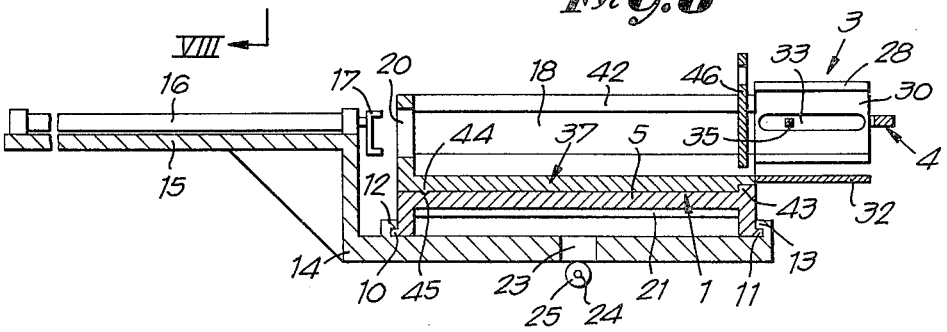
Figure 19:
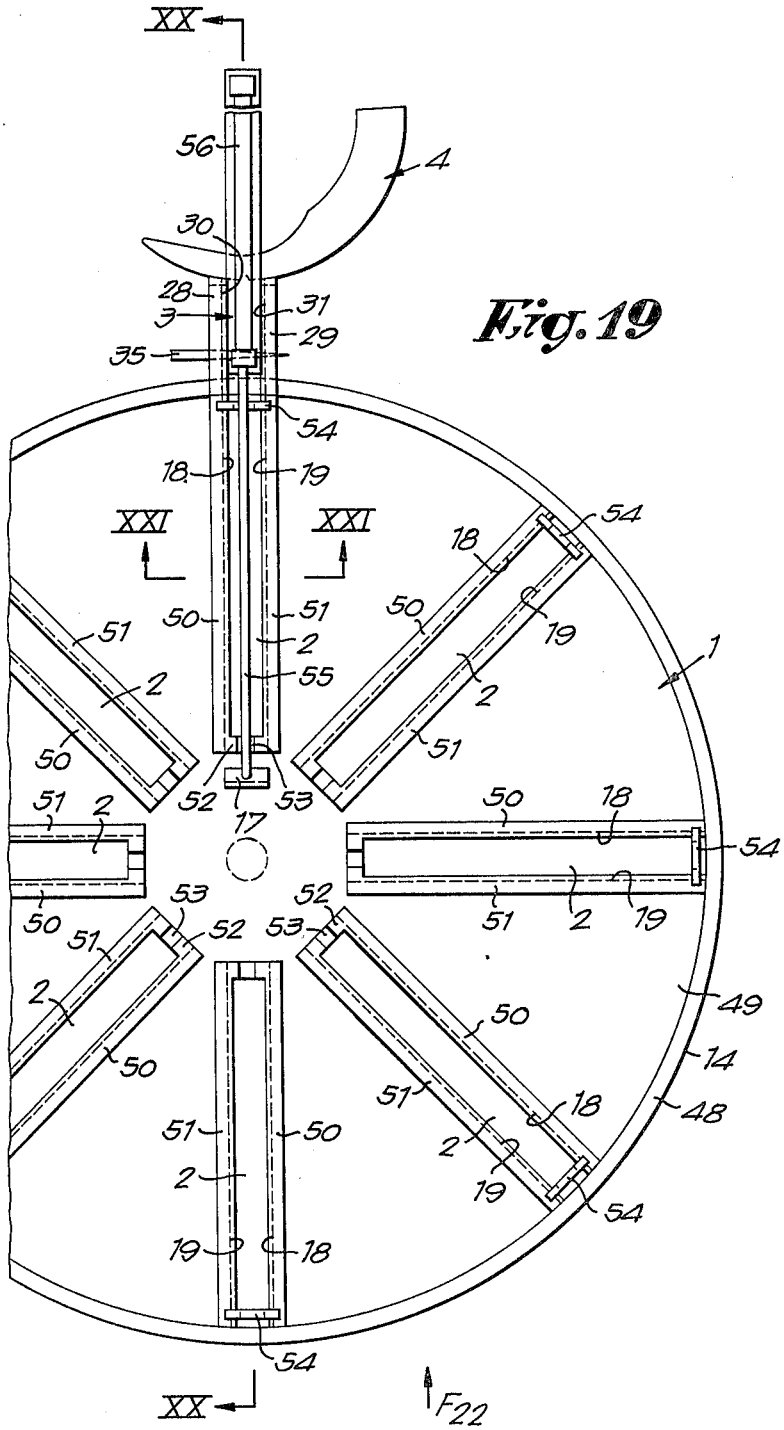
Figure 20:
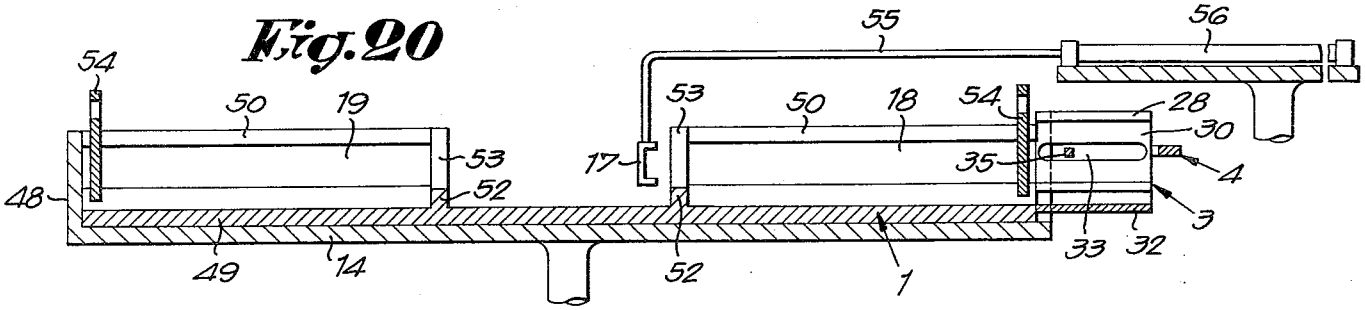
Figure 21:
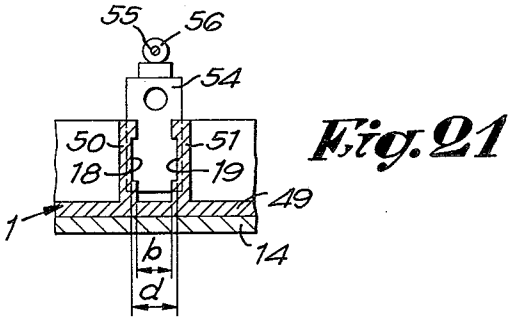
Figure 22:
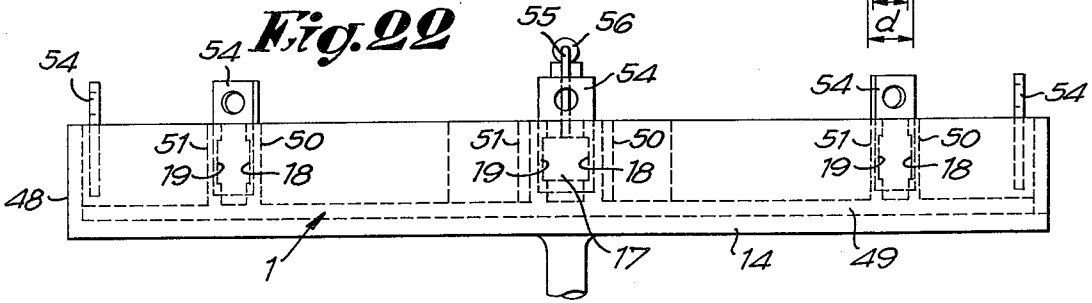
Figure 23:
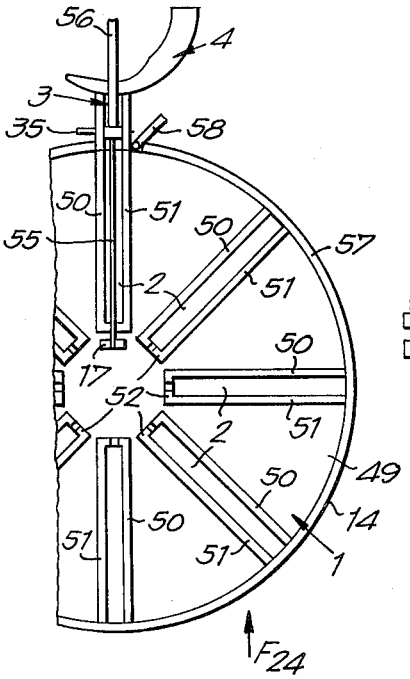
Figure 24:
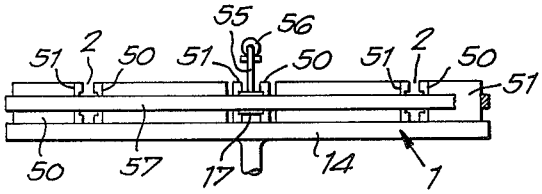
Figure 25:
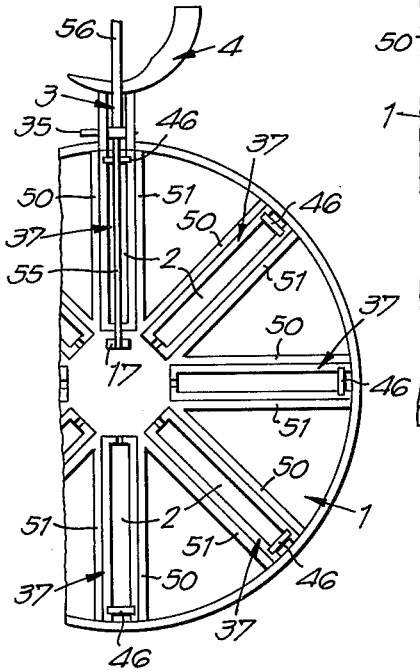
Figure 26:
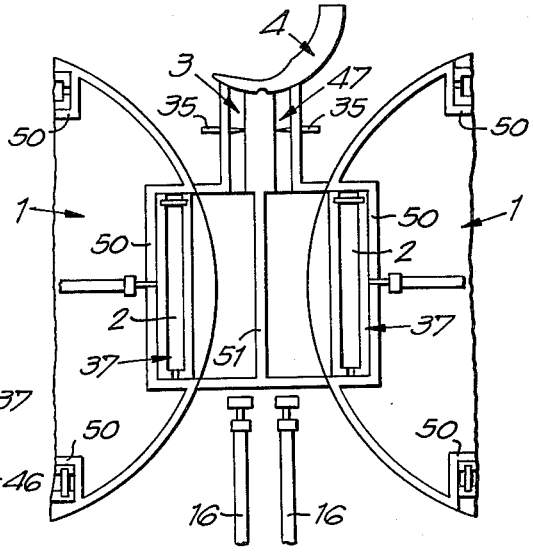

FIG. 13 also shows a view similar to the one of FIG. 1, but for a fibre loader according to the invention that is placed vertically;

FIGS. 14 and 15, respectively are sections according to the lines XIV—XIV and XV—XV in FIG. 13;

FIG. 16 is a view according to the arrow F16 in FIG. 13;

FIG. 17 is a view similar to the view of FIG. 13, but for a brush manufacturing machine with a double fibre magazine;

FIG. 18 is a view according to the arrow F18 in FIG. 17;

FIG. 19 shows a top plan view of an execution variant in which the fibre loader is made circular;

FIGS. 20 and 21 respectively are sections according to the lines XX—XX and XXI—XXI in FIG. 19;

FIG. 22 is a view according to the arrow F22 in FIG. 19;

FIGS. 23 and 25 are views similar to that of FIG. 19, but for execution variants;

FIG. 24 is a view according to the arrow F24 in FIG. 23;

FIG. 26 shows a variant of execution for the use of circular fibre loaders in combination with a machine having a double magazine.

In the FIGS. 1 through 6 is shown a device according to the invention, which in this case mainly consists of a fibre box 1, made for instance from plastic, wherein a number of fibre chambers 2, in the present case ten, are provided, the width of which corresponds to the width of the traditional fibre magazine 3 of a brush manufacturing machine along which the so-called feeder 4 moves to and fro.

The fibre box 1 has a bottom 5, on which are provided two end walls, 6–7 respectively and an appropriate number of intermediate walls 8 at appropriate mutual distances, and a side wall 9.

The fibre box 1 is provided on each side with a rib or a suchlike component, 10 and 11 respectively which can cooperate with guides, 12 and 13 respectively, of an appropriate table 14 which can be appropriately moved up and down, for instance by means of a pressure cylinder which is not shown. The table 14 also shows a projection 15 on which is mounted a pressure cylinder 16, a U-shaped pusher 17 being fixed on the free end of the piston rod of the pressure cylinder. The projection 15, respectively the pressure cylinder 16, are located so as to be in line with the fibre magazine 3.

In the walls 6, 7 and 8 of the fibre box 1, cut-outs, 18, 19 respectively, are provided over the full length, the dimensions of which are corresponding with the ones of the U-shaped pusher 17, so that these cut-outs 18 and 19 have the function of guides for this pusher 17, an aperture 20 being provided in the side wall 9, in order to ensure the access of the pusher 17 to each of the aforesaid chambers 2.

In this case, the bottom 5 of the fibre box is provided with projections 21 located underneath each wall 6, 7, 8, with which a driving element 22 can cooperate, which can move to and fro in a groove 23, which is therefore provided in the table 14 and which is, for instance, assembled to a piston rod 24 of a pressure cylinder mounted under the aforesaid table 14.

The aforesaid chambers 2 are closed at the open side opposite to the wall 9 by means of a slide 26 which passes through appropriate apertures 27, which are made for this purpose in the walls 7 and 8.

The fibre magazine 3 consists of two guides, 28 and 29 respectively, the mutual distance of which a is identical to or a little greater than the distance b between the walls 6 and 8, 7 and 8 and two walls 8, cut-outs, 30 and 31 respectively, being provided in the guides 28 and 29, so that the distance c, between the bottoms of these cut-outs 30–31, is equal to the distance d between the bottoms of two cut-outs 18 and 19 of a chamber 2, but with this difference that the cut-outs in the guides 28 and 29 are notably higher than the cut-outs in the fibre box 1, in order to allow a certain height setting, if the work is to be done with fibres of different lengths, as will be explained hereinafter.

Under the guides 28 and 29 is provided the traditional bottom 32 of the fibre magazine, which is adjustable in height and in each of the guides 28 and 29 there is provided a slot 33 and 34 respectively, wherein the pusher 35 can be placed and moved.

The use of a fibre loading device as described hereinabove is quite simple and as follows.

The fibre boxes 1 are filled beforehand with fibres, either on a separate machine, or, in the case of large concerns, in a separate workshop, the slide 26 being put into place in order to keep the fibres in the chamber 2. A certain quantity of the filled fibre boxes is then carried for instance nearby the brush manufacturing machine.

A box 1 which has been filled in this way is then slid into the guides 12 and 13 of the table 14 with the first chamber 2 in front of the fibre magazine 3, which at this moment is still filled with fibres, whilst the pressure on the fibres, required to have a certain quantity of fibres removed by the feeder 4, is obtained at this moment by means of the pusher 35, which is preferably driven by means of a spring or of a similar device.

When the first chamber 2 of the fibre box 1 is transported in front of the fibre magazine 3, the slide 26 is being removed, which is possible because of the table 14 excepting in way of the fibre magazine 3, having a raised edge 36 which keeps the fibres back.

At this moment, one will displace the U-shaped pusher 17 into the first chamber 2 to push in this way the fibres against the pusher 35, after which the latter will be pulled sidewards from the fibre magazine 3 and the fibres will be fed to the fibre feeder 4 by means of the pressure exerted by the pusher 17. When the latter comes from the chamber 2 into the fibre magazine 3, one will bring the pusher 35 again into the magazine 3, this pusher arriving between the flanges of the pusher 17 so that the pressure on the fibres in magazine 3 is now taken over by this pusher 35, so that the pusher 17 may be moved outside of the fibre box 1. At this moment, the driving device 22 will be moved in order to move the box 1 in relation to the table 14 by one step, in other words by one chamber 2, so that the following chamber 2 comes in front of the fibre magazine 3, after which the cycle repeats itself as explained hereinabove.

This can continue until the fibre magazine is entirely empty, after which a following box 1 is introduced without the functioning of the machine being interrupted.

It is clear that in this way there is obtained that the brush manufacturing machine gets a satisfactory autonomy so that only from time to time it is necessary to replace a fibre box 1.

When fibres with a different length must be processed, one will change the height of the bottom 32 of the fibre magazine 3, while the table 14 is moved over the same distance and the cooperation of the fibre box with the fibre magazine 3 remains possible because of the heights of the cut-outs 30 and 31 in this fibre magazine being greater than the height of the pusher 17.

In the FIGS. 7 through 12 is given an embodiment which is mainly to be compared with the embodiment described hereinabove, but in which the fibre box 1, in this case and if so wanted, can remain in the machine, as this fibre box is provided with cases 37, which are provided at the under side with protruding edges, 38 and 39 respectively, which can cooperate with cut-outs, 40 and 41 respectively, in the walls 42 of the fibre box, while the cases 37 are kept in the correct position in relation to the fibre loader 1, by means of, for instance, an abutment 43, on the one hand, and, for instance, a projection 44 on the case, which can cooperate with a notch 45 in the bottom of the fibre box, on the other hand.

Each case shows the aforesaid cut-outs 18 and 19, while the open end of same is appropriately closed by means of a slide 46 which, after the case is put into the fibre box 1, can be removed.

The way of functioning according to the FIGS. 7 through 12 is identical with the way of functioning described hereinabove, the only difference being that the cases can be filled with fibres elsewhere and can be introduced into the fibre box at the location of the brush manufacturing machine, whereby, in some specific cases, not only is the autonomy of such a machine improved, but the feeding of the machine with fibres is also simplified. Nothing, however, excludes, also in this case, to replace the whole fibre box 1 by cases 37.

In the embodiment according to FIGS. 13 through 16 is shown a fibre box 1 according to the invention that is placed vertically, the table 14 and the extension 15 consisting of two pieces which independently from each other and in relation to the fibre magazine 3 are adjustable, whereby in the fibre box, but now with the cases the one above the other, cases 37 are placed in the same way as hereinabove as in the embodiment according to the FIGS. 7 through 12, but with this difference that the slide 46 is placed on the side.

In this case also, the functioning of the device in itself remains about the same as the one described hereinabove and requires no further commentary.

It is clear that also in this case with vertical fibre boxes, a fibre box without cases 37 may be applied, but the execution with cases will be preferred as it is more simple to use.

In the FIGS. 19 through 22, a circular fibre box is shown, the table 14 which is movable up and down being formed in this case by a circular disk with a standup edge 48, which is interrupted at the location of the fibre magazine 3, while the fibre box 1 itself is formed by a circular plate 49 with thereon a number of chambers 2, which each comprise side walls, 50–51 respectively, wherein the aforesaid cut-outs 18 and 19 are provided; an end wall 52 which is provided with a passage 53 for a pusher and a slide 54 which, when the fibre box is placed on the table 14, may be removed.

In this case, the pusher 17 is fixed at the end of rod 55 bent over 90°, which itself is fixed on the end of the piston rod of a pressure cylinder 56.

In this case also, the manner of functioning is clear and about the same as described hereinabove, with this difference that the fibre box will always be turned on step by means of an appropriate device, not drawn, for instance a ratchet with a ratchet drive.

In the FIGS. 23 and 24 there is given an execution variant of the execution according to FIGS. 19 through 22, in which the table 14 simply consists of a circular plate on which the fibre box is suitably located by any means whatever, which are not shown, the fibre box properly speaking consisting of the plate 49 on which are provided the walls 50–51 and 52, the slides 54, however, being replaced by a ring 57 having a pivotable part 58, which can be opened by pivoting, in order to make it possible to push the fibres out at the location of the fibre magazine.

In FIG. 25, there is schematically shown that a circular fibre box 1 according to the invention may also be provided with suitable cases 37 while in FIG. 26 is finally shown in which way, from circular fibre boxes, a double fibre magazine, 3–47 respectively, can be fed with a great autonomy.

It is clear that the present invention is not at all limited to the embodiments described as examples and shown in the attached drawings, but that a suchlike fibre loading device according to the invention may be made in various shapes and with various dimensions without going beyond the scope of the present invention.

What I claim is:

1. A fibre loading device for a brush manufacturing machine having a fibre magazine, which device comprises:

(a) a displaceable table for mounting adjacent a fibre magazine and including a vertical wall disposable adjacent the magazine;

(b) means for displacing the table;

(c) a displaceable fibre box carried by the table, which box includes a plurality of adjacent fibre chambers, each fibre chamber being defined by a bottom, an open end wall disposable adjacent the fibre magazine, two side walls, and an end wall having a first aperture therethrough;

(d) a plurality of fibre cartridges, each fibre cartridge being disposable in a corresponding fibre chamber, with each fibre cartridge having a U-shaped chamber defined by a bottom, a fixed end wall having a second aperture therethrough, a removable end wall for temporarily securing the fibres in the fibre cartridge, and two side walls, each side wall including an inner longitudinal groove;

(e) means for displacing the fibre box to successively align the fibre cartridges with the fibre magazine; and (f) means for transferring fibres from each fibre cartridge into the fibre magazine when each fibre cartridge is aligned with the fibre magazine and after the removable end wall of the fibre cartridge has been removed, the transfer means being movable through the first and second apertures of each fibre box and its corresponding fibre cartridge and through the cartridge, with the transfer means being guided by the longitudinal grooves in the fibre cartridge.

2. The fibre loading device of claim 1 wherein:

(a) each fibre cartridge includes a first abutment at one end disposable adjacent the fibre magazine and a projection at an opposite end; and (b) the fibre box includes a second abutment and a recess, the second abutment being engageable by the first abutment and the recess being engageable by the projection for securing the fibre cartridge in the fibre box.

3. The fibre loading device of claim 1 wherein:

(a) each fibre cartridge includes a rib carried by each side wall; and (b) each fibre chamber of the fibre box includes a pair of opposed grooves engageable by the ribs of its corresponding fibre cartridge.

4. The fibre loading device of claim 1 wherein the transfer means includes:

(a) a pressure cylinder provided with a piston rod;

(b) a pusher carried by the piston rod for pushing the fibres; and (c) the table includes an extended portion for supporting the pressure cylinder.

5. The fibre loading device of claim 1 wherein:

(a) the fibre box includes a plurality of downwardly directed projections spaced by distances corresponding to the width of the fibre chambers and a plurality of longitudinal ribs;

(b) the downwardly directed projections being engageable by the displacement means; and (c) the table including a plurality of longitudinal guides engageable by the longitudinal ribs for guiding the fibre box during displacement of same.

* * * * *